US006424598B1

(12) United States Patent
Shultz

(10) Patent No.: US 6,424,598 B1
(45) Date of Patent: Jul. 23, 2002

(54) INTERVAL TIMING APPARATUS FOR ATHLETIC EVENTS

(76) Inventor: Michael W. Shultz, 315 Struthers Liberty Rd., Campbell, OH (US) 44405

( * ) Notice: Subject to any disclaimer, the term of this patent is extended or adjusted under 35 U.S.C. 154(b) by 36 days.

(21) Appl. No.: 09/730,268

(22) Filed: Dec. 5, 2000

(51) Int. Cl.[7] ..... G04B 47/00
(52) U.S. Cl. ..... 368/3; 368/10; 248/116
(58) Field of Search ..... 368/3, 10, 223; 473/415 E; 248/116; D11/128; 211/131.1, 131.2, 133.1

(56) References Cited

U.S. PATENT DOCUMENTS

| | | | | |
|---|---|---|---|---|
| 129,105 A | * | 7/1872 | Collier | 248/116 |
| 2,308,037 A | | 1/1943 | Abadjieff | |
| 3,665,452 A | | 5/1972 | MacCreadie | |
| 5,084,696 A | | 1/1992 | Guscott et al. | |
| 5,130,955 A | | 7/1992 | Luerker et al. | |
| 5,181,009 A | | 1/1993 | Perona | |
| 5,294,111 A | * | 3/1994 | Bloch | 473/415 |
| 5,861,808 A | | 1/1999 | Lehmann et al. | |
| 5,912,864 A | * | 6/1999 | Maurer | 368/10 |

* cited by examiner

*Primary Examiner*—Vit Miska
*Assistant Examiner*—Jeanne-Marguerite Goodwin
(74) *Attorney, Agent, or Firm*—Robert J. Herberger

(57) ABSTRACT

An interval timing apparatus for use with a football during games or scrimmages. The timing apparatus comprises a stand having a holding area with a recessed shape to hold a football in a substantially horizontal position and a timer having a sensor communicating with the holding area so that when the football is removed from the holding area, the timer is deployed. The timer is operatively connected to a visual display showing the time generated by the timer. When the predetermined time has lapsed, an audio signal is generated by an alarm operatively connected to the timer.

10 Claims, 4 Drawing Sheets

INTERVAL TIMING APPARATUS FOR ATHLETIC EVENTS

FIELD OF THE INVENTION

This invention relates to a timing apparatus for pacing and maintaining select time. intervals in sporting events, and more particularly, to aid players of football games to keep track and limit certain times elapsed during play.

BACKGROUND OF THE INVENTION

Flag football and other forms of "backyard" football are commonly played by adults and children, professional and amateur athletes alike. The widespread popularity of this game lies in its simplicity, the lack of expensive and cumbersome equipment as compared to other sports, and the ability to play this game anywhere open space is available.

The informality of the game has its drawbacks, however. The lack of officials and sophisticated timing equipment-results in some logistical problems for the casual football player. The quarterback must make a play within a specific time interval, usually 5 to 12 seconds, and without a referee and a clock, it is difficult for players to gauge how much time has elapsed and thus whether the play was made in the requisite time interval. Currently, players rely on mental counting of the seconds, verbally counting the seconds, digital wrist watches with mini alarms, and even bystanders counting out the time. However, none of these methods are satisfactory because they are inconvenient to implement or unreliable during play.

SUMMARY OF THE INVENTION

The present invention is directed to a timing apparatus for use with a football during play. More specifically, it satisfies the need for a convenient and reliable method of keeping track of predetermined intervals of time during plays in a football game.

The instant invention comprises a stand having a top surface and at least one leg attached thereto. Located on the top surface is a holding area for resting a football and a timer having a sensor that communicates with the holding area so that when the football is at rest in the holding area the timer is reset and stopped. When the sensor detects that the football is removed from the holding area, the timer starts. Further, the timer is connected to a display to visually show the precise time on the timer. An alarm, which communicates with the timer, emits an audio signal after the predetermined time has elapsed, signaling to all players that the quarterback's time to release the football during the play is finished. The time interval is adjustably programmable. Additionally, the invention can also include an electronic storage device for other useful information, such as number of downs and/or the score.

The present invention overcomes the current problems of precisely and uniformly tracking time, keeping all players appraised of the same and keep the game moving at a steady and enjoyable pace. It is also safe, economical, easy to use, requires no extra people to operate and is readily portable.

BRIEF DESCRIPTION OF THE DRAWINGS

It is to be understood that the drawings are designed for the purpose of illustration only and not as a definition of the limits of the instant invention, for which reference should be made to the claims appended hereto. Other features, objects and advantages of this invention will become clear from the following detailed description made with reference to the drawings in which:

DETAILED DESCRIPTION OF THE PREFERRED EMBODIMENTS

Figure 1:
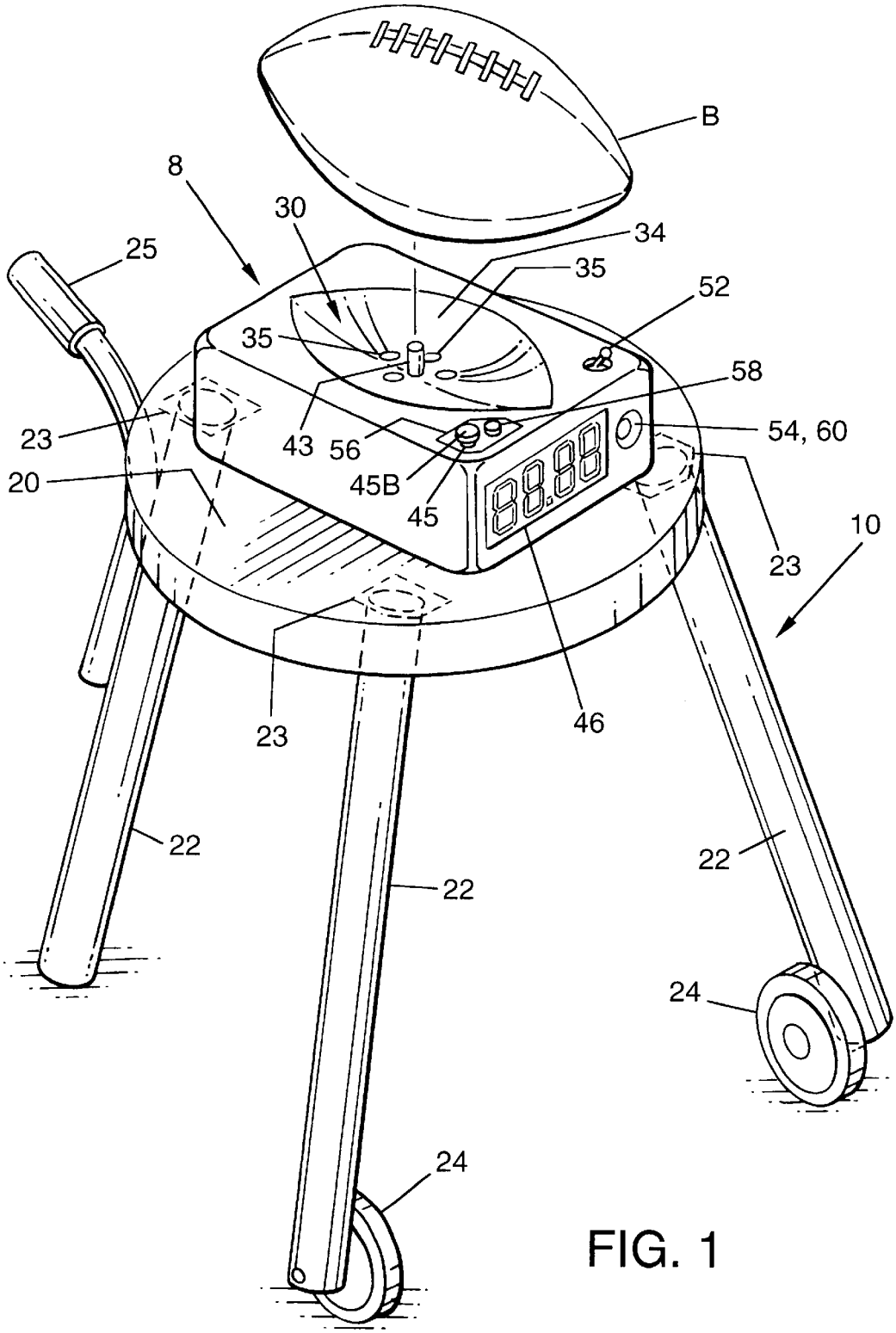
FIG. 1 is an exploded perspective view of the present invention showing the placement of the football thereon.

The present invention is-directed to a portable timing apparatus 8 for pacing and maintaining select time intervals during the play of a football game or scrimmage. As shown in FIG. 1, the timing apparatus 8 comprises a stand 10 having a plurality of legs or supports 22 affixed thereto. The stand 10 further comprises a planar top surface 20 having a holding area 30.

More specifically, the supports 22, preferably three, extend from the top surface 20 of the stand 10 to the ground, thereby elevating the top surface 20 between two to three feet off of the ground. The stand 10, preferably triangular in shape, has supports 22 at the corners of the top surface 20. Supports 22 may be affixed to the stand 10 by way of fasteners or the supports 22 may be molded therewith to form a single piece. In another embodiment, however, supports 22 may be attached to stand 10 by hinges 23 so that the stand 10 is selectively collapsible and thus more easily stored and transported when not in use. Attached to at least one of the supports 22 is a wheel 24 to aid in transporting the stand 10 on the field while in use. In working conjunction therewith is a handle 25 for pulling the stand 10 on said wheel 24.

Figure 2:
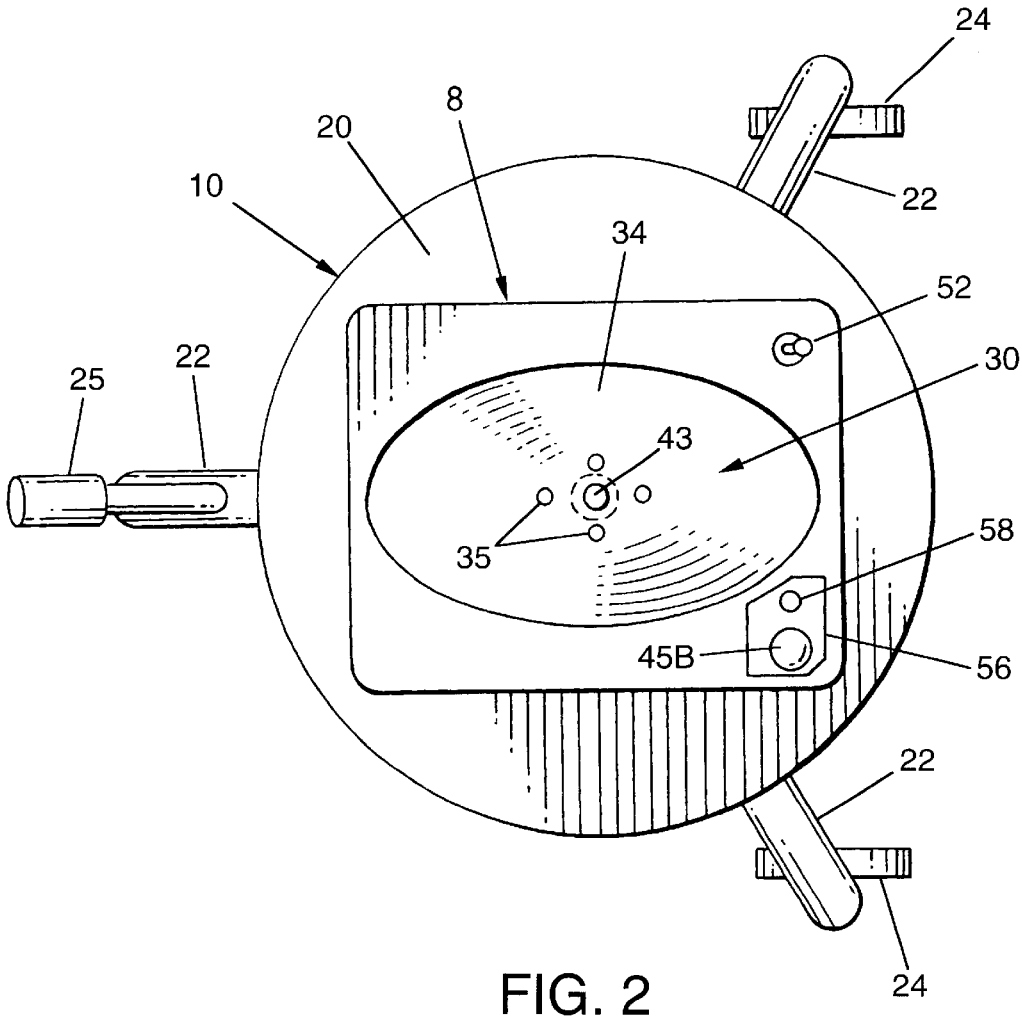
FIG. 2 is a top plan view of the invention.
Figure 3:
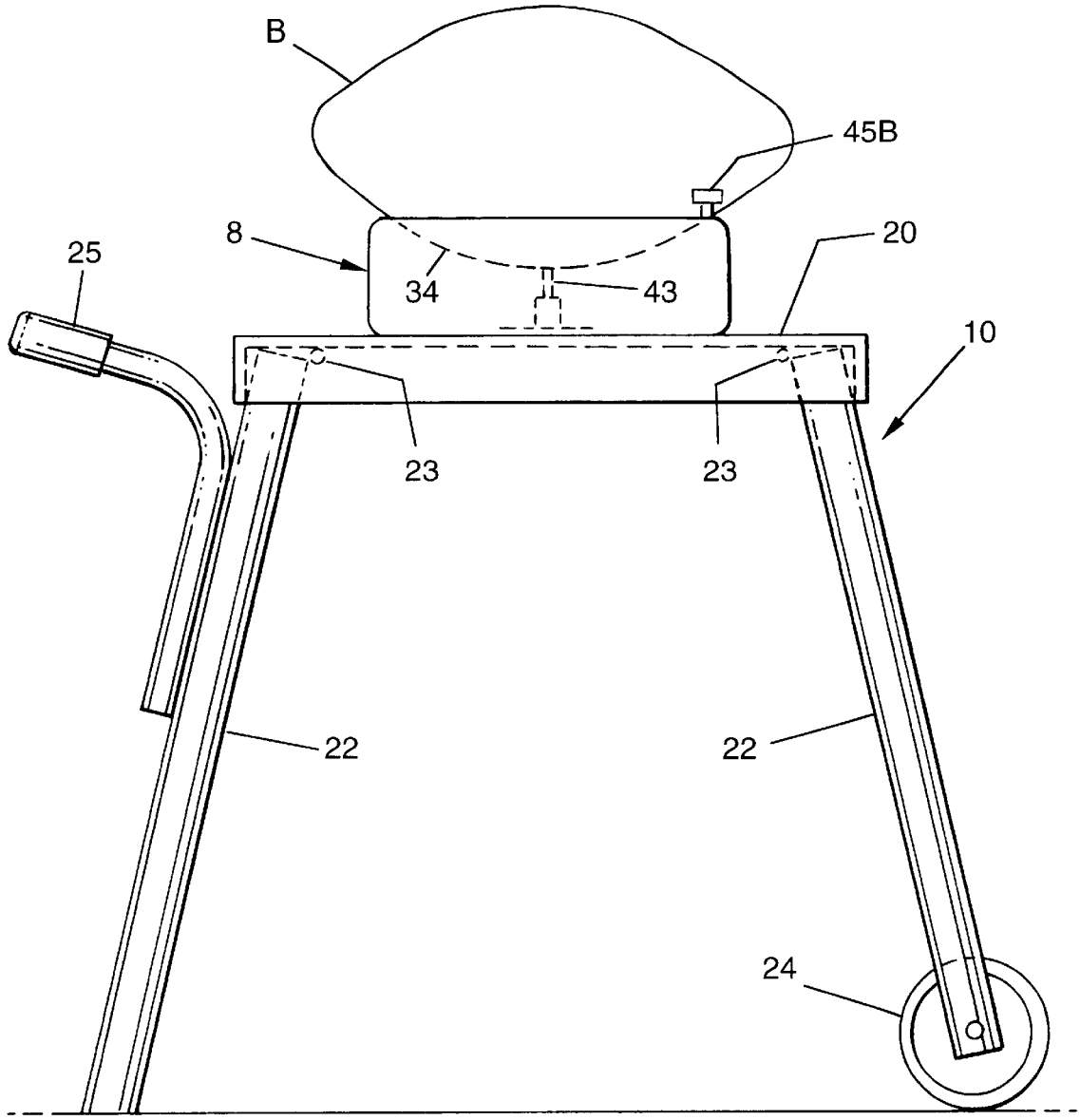
FIG. 3 is a side elevational view of the invention.
Figure 4:
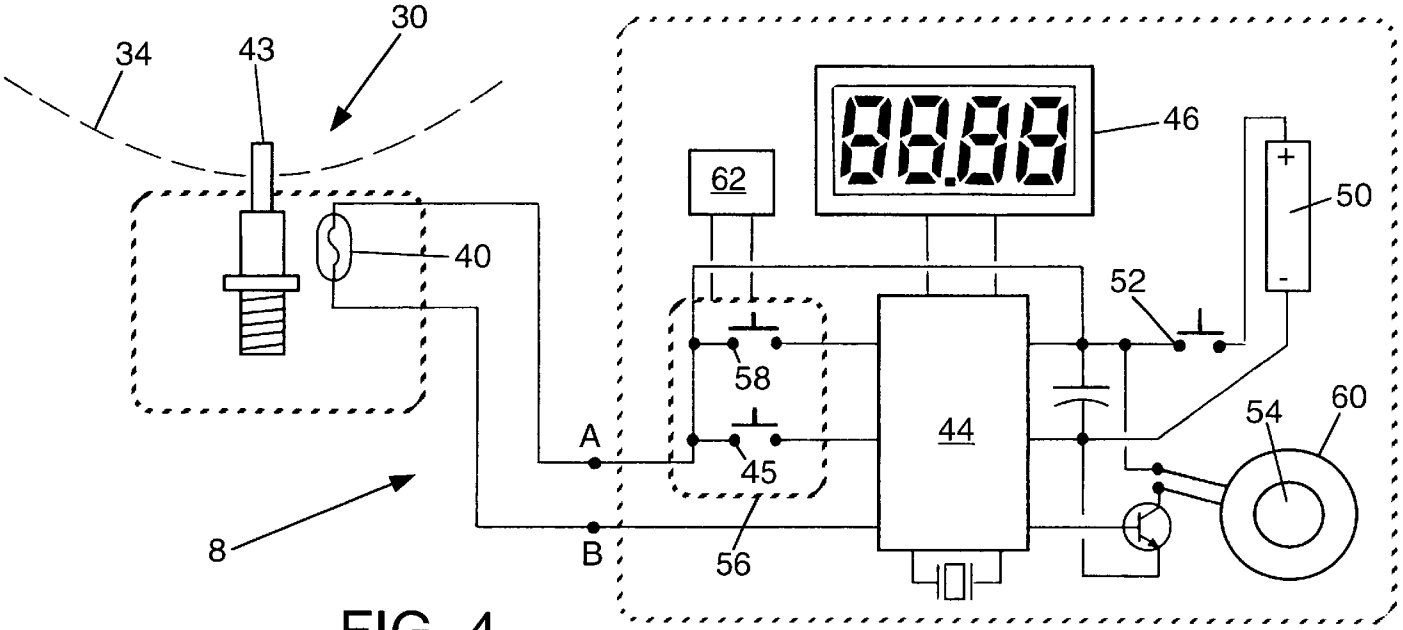
FIG. 4 schematically shows a circuit diagram of the switch operating with the timer.
Figure 4B:
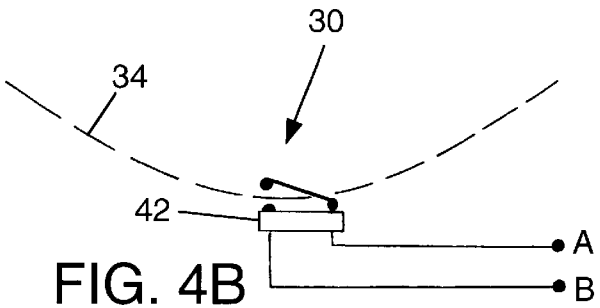
FIG. 4B schematically shows another embodiment using a micro-switch to start the timer.
Figure 4A:
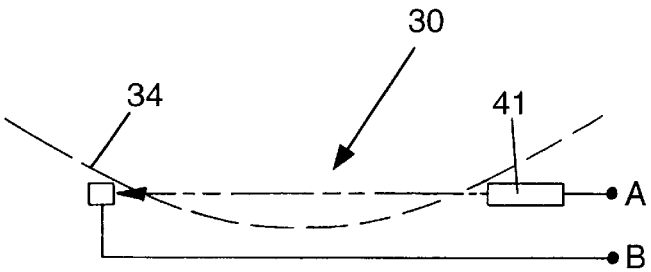
FIG. 4A schematically shows a second embodiment using a photosensor.

Now viewing FIGS. 1 and 2, holding area 30 comprises a recess 34 having an elliptical shape that is sized to fit the placement of the football B held therein substantially horizontal to the ground. The holding area 30 has small openings or holes 35 to allow rain and other moisture to naturally drain therefrom. A sensor 40, as seen in FIG. 4, is located within the recess 34, preferably at the bottom therein. The sensor 40 may be a photosensor 41 or micro-switch 42 comprising a spring loaded plunger 43. The sensor 40 is operatively connected to a timer 44 and display 46. The timer 44 is powered by a D.C. power source. 50 connected to an on/off switch 52. Incorporated with the timer 44 and display 46 is an alarm 54. To operate, the timing apparatus 8 of the instant invention is turned on via the on/off switch 52. The select time interval is programmed and set by the operator at a control panel 56 having a timer interface control set switch 58. By engaging the sensor 40 via depressing micro-switch 42 (which is normally closed) or covering the photosensor 41 with the-football B at rest in the holding area 30, the timer 44 stops and by pressing reset 45, the timer 44 is set to the preset time. Releasing the micro-switch 42 or uncovering the photosensor 41 then starts the timer 44. After the preset time has elapsed, alarm 54 generates an audio signal emitted through speakers 60. The audio signal is emitted for a period of 2 to 6 seconds before automatically stopping. The control panel 56 may further include controls for manually inputting information such as the total allowable play time, scores and/or downs to an electronic storage device 62 (as is known in the art) mounted on the stand 10.

In use during play, the invention is positioned on the field at the line of scrimmage, where. in typical play without the instant invention a center would deliver the football B to the quarterback. With the instant invention, the-football B is positioned in the holding area 30 and power is turned on via the on/off switch 52. Timer 44 is programmed and set using the timer interface control set switch 58 to the desired time interval preferably measured in seconds. The quarterback then resets the timer 44 to the set time by pushing reset 45. Then, when the quarterback picks up the football B to initiate a play, the sensor 40 detects the same and the timer 44 starts. The time on the timer 44 is displayed on display 46, visually showing the time being counted down by seconds. The time, however, may count upward thereby accomplishing the same task (i.e. measuring a predetermined time span).

After initiating the play, the quarterback has the preset time to get rid of the ball or run past the line of scrimmage. If time-lapses and the quarterback has not passed the ball or run accordingly, the audio signal is generated indicating that the play is dead and the down is over. If the quarterback has completed the play before the preset time has lapsed, the play continues in accordance with standard rules of play. After the play is completed, the timing apparatus 8 is moved to the new line of scrimmage, if changed, and the quarterback once again positions the football B in the holding area 30. The quarterback then engages the reset 45 to restart the cycle for the next play. For convenience, it is preferable that the reset 45 comprises a large push button 45B, much like the button used with a typical emergency stop switch known in the art, so that the player can easily access the same during the rush of the game.

While a preferred embodiment of the invention has been illustrated and described, it is to be understood that various changes can be made therein without departing from the spirit and scope of the invention. Thus, the invention is to be limited only by the scope of the claims that follow.

What is claimed is:

1. A portable timing apparatus for use with a football during play, the timing apparatus comprising:

a stand having a top surface and at least three legs attached thereto and the legs being collapsible, said top surface having a holding area for resting the football, the holding area having an opening through the top surface for drainage;

a handle attached to the stand for manually maneuvering the apparatus;

a timer having a sensor, said sensor communicating with said holding area so that when the football is at rest in the holding area the timer is reset and stopped and when the football is removed from the holding area the timer is started, said timer is operatively connected to a display for visually showing the time generated by the timer;

an alarm communicating with said timer whereby an audio signal is generated after a predetermined time has elapsed on the timer; and a power source connected to said timer and alarm.

2. The portable timing apparatus of claim 1, wherein the sensor is a micro-switch comprising a spring loaded plunger.

3. The portable timing apparatus of claim 2, wherein the holding area is recessed to restrain the football at rest therein.

4. The portable timing apparatus of claim 1, wherein the sensor is a photosensor.

5. The portable apparatus of claim 4, wherein the power source includes a battery and the stand comprises a wheel attached to one of the collapsible legs.

6. A portable interval timing apparatus for use with a football in a game, the timing apparatus comprising:

a stand having a planar top surface and a support attached thereto extending to the ground, said top surface comprising a holding area for placing the football at rest in a substantially horizontal position, the holding area having an opening through the top surface for drainage;

the support having a plurality of collapsible legs and a handle for manually maneuvering the apparatus;

a timer having a sensor whereby when the football is detected by the sensor in the holding area the timer is stopped and reset, said timer being operatively connected to a display for visually displaying the time thereon;

an alarm communicating with said timer whereby an audio signal is generated after a predetermined time has elapsed on the timer; and a power source connected to said timer and alarm.

7. The portable timing apparatus of claim 6, wherein the sensor is a micro-switch comprising a spring loaded plunger which is manipulated by the weight of the football.

8. The portable timing apparatus of claim 6, wherein the sensor is a photosensor.

9. The portable timing apparatus of claim 6, wherein the holding area is recessed to hold the football at rest therein.

10. The portable apparatus of claim 9, wherein the power source comprises a battery and the support comprises a wheel attached to at least one of the collapsible legs.

* * * * *